United States Patent [19]

Myers

[11] 4,191,949

[45] Mar. 4, 1980

[54] BELT HAVING A POSTURE WARNING DEVICE

[76] Inventor: Dick T. Myers, R.D. #2, Austin Dr., Willard, Ohio 44890

[21] Appl. No.: 951,524

[22] Filed: Oct. 16, 1978

[51] Int. Cl.[2] ..... G08B 21/00

[52] U.S. Cl. ..... 340/573; 35/29 D; 200/DIG. 2

[58] Field of Search ..... 340/573; 200/DIG. 2, 200/61.4; 35/29 D

[56] References Cited

U.S. PATENT DOCUMENTS

| | | | |
|---|---|---|---|
| 2,135,476 | 11/1938 | Rugh | 200/DIG. 2 |
| 3,582,935 | 6/1971 | Verhaeghe | 340/573 |
| 3,670,320 | 6/1972 | Palmer | 340/573 |

*Primary Examiner*—Glen R. Swann, III

*Attorney, Agent, or Firm*—Oldham, Oldham, Hudak & Weber

[57] ABSTRACT

A belt has a posture warning device maintained therein. The belt includes a strap with a buckle at one end thereof. The strap includes pockets which receive a battery and an electrical bell or buzzer. An electrical contact is maintained on the strap and connected to the battery, while the buzzer is electrically connected to the buckle. Movement of the buckle against the electrical contact completes the circuit between the battery and buzzer to emit a sound indicating to a wearer that he has allowed his abdominal muscles to relax to a point evidencing bad posture. The buckle is biased away from the electrical contact by means of springs interconnected between the strap and buckle such that, when the wearer evidences good posture and abdominal muscle control, the buzzer is inactive.

10 Claims, 2 Drawing Figures

BELT HAVING A POSTURE WARNING DEVICE

BACKGROUND OF THE INVENTION

Presently, the populace is becoming increasingly aware of personal physical appearance. More particularly, people are becoming aware of weight problems and, to overcome such weight problems, many members of the public place themselves on any of numerous diets to slim and trim their figures to maintain an attractive appearance. However, even those people who do not have weight problems often appear to be overweight because of poor posture. Indeed, a rather trim individual may appear to have a "pot belly" because he exercises poor control over his abdominal muscles, allowing his stomach to expand against his belt line to an unsightly extent. While weight control is a very real problem for many persons, and one which has been recognized by "fad" diets and the like, there is an equally serious problem with poor posture habits and, to date, no aids have been provided to the general public to assist them in overcoming such problems.

OBJECTS OF THE INVENTION

In light of the foregoing, it is an object of the instant invention to provide a belt having a posture warning device which advises the wearer by an audible tone when he has allowed his abdominal muscles to relax to an unsightly extent.

It is another object of the invention to provide a belt having a posture warning device which is not readily noticeable when being worn, but instead looks like an ordinary belt.

Yet another object of the invention is to provide a belt having a posture warning device which, without additional weight or burden, may be worn as ordinary apparel.

Still a further object of the invention is to provide a belt having a posture warning device which is inexpensive to construct, reliable in operation, and readily implemented using presently available state-of-the-art apparatus and techniques.

SUMMARY OF THE INVENTION

The foregoing and other objects of the invention which will become apparent as the detailed description proceeds are achieved by a belt having a posture warning device, comprising: a belt strap having a buckle secured to one end thereof; warning means interposed between said strap and said buckle for emitting a signal when relative movement between said strap and buckle exceeds a predetermined amount; and biasing means interconnected between said buckle and strap for urging said buckle and strap into separated positional relationship with respect to each other.

DESCRIPTION OF THE DRAWING

For a complete understanding of the objects, techniques, and structure of the invention reference should be had to the following detailed description and accompanying drawing wherein.

DETAILED DESCRIPTION OF PREFERRED EMBODIMENT

Figure 1:
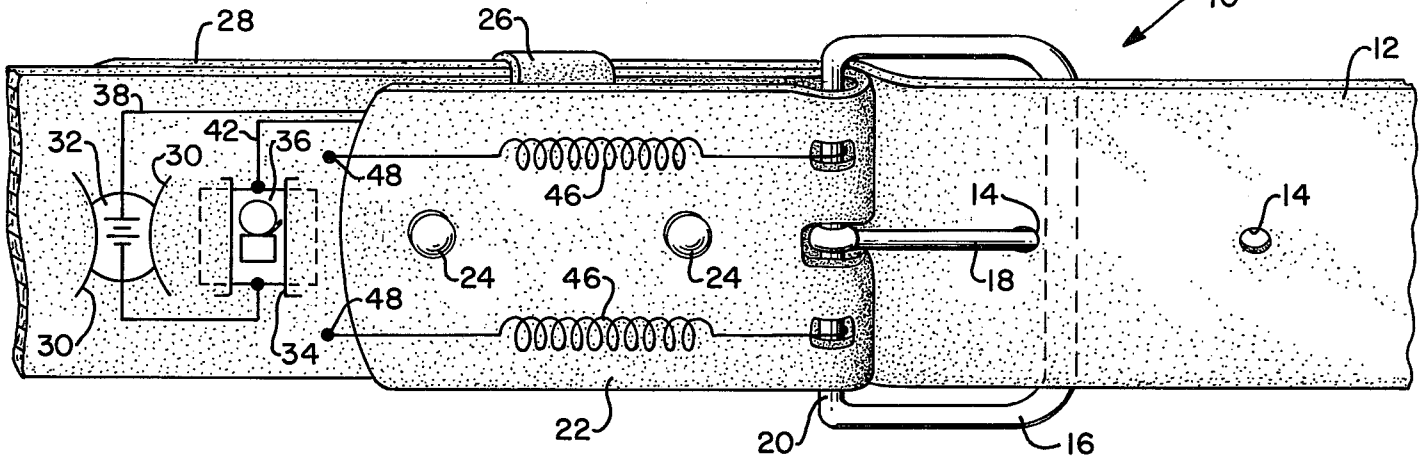
FIG. 1 is a perspective view of the underside of a belt and buckle assembly incorporating the teachings of the invention.

Referring now to the drawing and more particularly FIG. 1, it can be seen that a belt having a posture warning device is designated generally by the numeral 10. The assembly 10 includes a belt strap 12 which may be constructed of leather, vinyl, or other appropriate standard material. Included in the belt strap 12 are a plurality of holes 14 for adjusting the length of the belt as required by the user. Of course, a buckle 16, having a prong 18 pivotally mounted about a spindle 20, is also included; the prong 18 being received within the appropriate adjustment hole 14 as desired by the wearer. The spindle 20 is secured to the belt strap 12 by means of the lap 22 created by folding the strap back upon itself. In standard fashion, the lap 22 is then secured to the strap proper by means of rivets or the like 24. Interposed between the rivets 24 is a belt loop 26 for receiving the end of the belt 28 as determined by the selective engagement of the prong 18 with one of the holes 14.

Included as part and parcel of the belt strap 12 are flaps 30 which define a pocket for receiving a battery 32. The battery 32 has the physical appearance of a flat disk and is of a nature similar to those used in cameras, hearing aids, and the like. A second set of flaps 34 is operative for receiving a small bell, buzzer, horn, or other electrical alarm 36. Again, small alarms, of the nature required for the belt structure 10, are readily available in the art, such as those used in children's toys.

Figure 2:
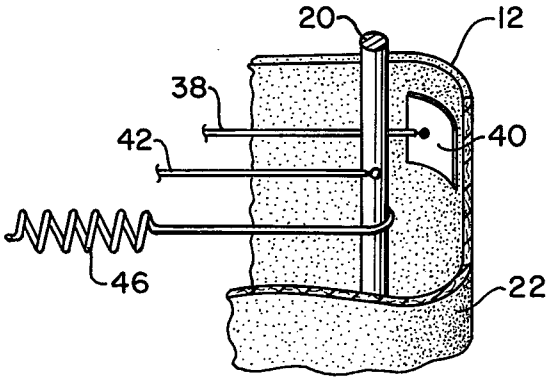
FIG. 2 is a partial sectional view of the apparatus of FIG. 1 showing the positional relationship maintained between the buckle spindle and the electrical contact operative for energizing the warning device.

With continuing reference to FIG. 1 and specific reference of FIG. 2, it can be seen that a wire 38 passes from one of the terminals of the battery 32, to a contact pad 40 affixed to the belt strap 12 at the point of the loop formed by the lap 22. This contact pad 40 is made of current-conducting material such as copper, aluminum, tin, or the like, and may be affixed to the belt strap 12 at this point by means of an appropriate adhesive. Suffice it to say that the contact pad 40 is in juxtaposition to the spindle 20, with the spindle 20 being connected to the alarm 36 by means of the wire 42. With the alarm 36 and remaining terminal of the battery 32 being interconnected by the wire 44, it can be seen that when the spindle 20 contacts the electrical contact 40 a circuit is completed between the battery 32 and alarm 36. The result is a sounding of the alarm and the emitting of a sound.

To keep the spindle 20 from completing the circuit just described, springs or other biasing means 46 are interconnected between the spindle 20 and posts, rivets, holes, or other securing means 48 within the strap 12 itself. As shown in the drawing, with the springs 46 extended between the spindle 20 and the securing means 48, the spindle 20 is drawn away from the contact 40 and the circuit between the battery 32 and alarm 36 is open. However, if the wearer allows his abdominal muscles to relax, expanding his stomach, a tensile force is exerted into the belt strap 12. With the belt strap 12 being bound by the buckle proper, and particularly the prong 18 and holes 14, this tensile force pulls the spindle 20 against the biasing of the springs 46 and toward the electrical contact 40. If the wearer has allowed his abdominal muscles to relax to the point that the natural gap between the spindle 20 and contact 40 is closed against the biasing of the springs 46, the circuit is completed and the battery 32 energizes the alarm 36. Immediately, the wearer is notified that he has allowed his posture to become degraded and he may respond by again tightening his abdominal muscles. When this occurs, tension in the strap 12 is reduced and the springs 46 are then sufficient to urge the spindle 20 out of the current conducting relationship with the contact 40.

Thus, it can be seen that there has been provided a novel belt assembly by which the wearer may be audibly advised when his posture has degraded beyond a particular point. The belt assembly 10 may most comfortably be worn by one in the privacy of his home, or outside of publicly traveled areas, to save embarrassment. By including the snap-on connectors for interconnecting, for example, the wires 38,44 to the battery 32, one could easily choose whether to activate the alarm assembly at any particular time. Indeed, with the belt strap 12 and buckle 16 being of ordinary construction and appearance, and with the battery and alarm apparatus being small in size and maintained on the underside of the belt strap, one can easily wear the belt assembly 10 as ordinary wearing apparel with or without the activated alarm system. The flaps 30,34 allow the wearer to completely remove the elements for conventional use of the belt or for replacement purposes.

Thus it can be seen that the objects of the invention have been satisfied by the structure presented hereinabove. While in accordance with the patent statutes only the best mode and preferred embodiment of the invention has been presented and described in detail, it is to be understood that the invention is not limited thereto or thereby. Consequently, for an understanding of the true scope and breadth of the invention, reference should be had to the following claims.

What is claimed is:

1. A belt having a posture warning device, comprising:

a belt strap having a buckle secured to one end thereof;

warning means interposed between said strap and said buckle for emitting a signal when relative movement between said strap and buckle exceeds a predetermined amount; and biasing means interconnected between said buckle and strap for urging said buckle and strap into separated positional relationship with respect to each other.

2. The belt according to claim 1 wherein said warning means includes a battery and an alarm, said buckle being interposed therebetween for selectively interconnecting said battery and alarm.

3. The belt according to claim 2 wherein said alarm comprises a buzzer.

4. The belt according to claim 2 wherein said buckle includes a spindle and said biasing means comprises a spring connected at one end thereof to said belt strap and at the other end thereof to said spindle.

5. The belt according to claim 4 wherein said spindle is connected to said alarm and said strap includes a contact pad in juxtaposition to said spindle and connected to said battery, said spring urging said spindle from said contact pad.

6. The belt according to claim 2 wherein said belt strap includes pockets for receiving said battery and alarm.

7. A belt for advising the wearer of bad posture, comprising:

a buckle;

a belt strap operatively connected to said buckle;

warning means interconnected between said buckle and strap for producing a signal when said buckle and strap move into predetermined point-contacting relationship with each other; and biasing means interconnecting said strap and buckle for urging said buckle and strap away from said point-contacting relationship.

8. The belt according to claim 7 wherein said warning means comprises a battery and alarm.

9. The belt according to claim 7 wherein said biasing means comprises a spring interconnected at opposite ends between said strap and said buckle.

10. The belt according to claim 7 wherein said strap has an electrical contact connected thereto in juxtaposition with said buckle, said warning means comprises a battery and alarm interconnected between said buckle and said electrical contact, and wherein said biasing means comprises springs interconnected between said strap and buckle and biasing said buckle away from said electrical contact.

* * * * *